US008729959B1

(12) United States Patent
Chen

(10) Patent No.: US 8,729,959 B1
(45) Date of Patent: May 20, 2014

(54) VOLTAGE GENERATING APPARATUS

(71) Applicant: ISSC Technologies Corp., Hsinchu (TW)

(72) Inventor: Yi-Lung Chen, Hsinchu (TW)

(73) Assignee: ISSC Technologies Corp., Hsinchu (TW)

( * ) Notice: Subject to any disclaimer, the term of this patent is extended or adjusted under 35 U.S.C. 154(b) by 0 days.

(21) Appl. No.: 13/962,975

(22) Filed: Aug. 9, 2013

(51) Int. Cl.
*G05F 1/10* (2006.01)

(52) U.S. Cl.
USPC ..... 327/540; 327/538

(58) Field of Classification Search
USPC ..... 327/539, 530, 538, 540, 541, 542, 543, 327/560, 561, 562, 563; 322/17, 28, 29; 324/601
See application file for complete search history.

(56) References Cited

U.S. PATENT DOCUMENTS

2008/0136503 A1* 6/2008 Au et al. ..... 327/538
2012/0212286 A1* 8/2012 Yokou et al. ..... 327/537

* cited by examiner

*Primary Examiner* — Lincoln Donovan
*Assistant Examiner* — Jung H Kim
(74) *Attorney, Agent, or Firm* — Jianq Chyun IP Office

(57) ABSTRACT

A voltage generating apparatus is provided. The voltage generating apparatus includes a reference voltage generator and an output voltage generator. The reference voltage generator is used for generating a reference voltage, and the reference voltage generator decides to generate the reference voltage or not according to a control signal. The output voltage generator includes a comparator, a variable resistor and a current source. The comparator compares the reference voltage and an output voltage to generator a calibrating signal. A resistance of the variable resistor is decided by the calibrating signal. The current source provides an output current to flow through the variable resistor for generating the output voltage. Wherein, the reference voltage is generated during an initial timing period, and the generator is turned off after the initial timing period. The initial timing period is determined according to the control signal.

8 Claims, 3 Drawing Sheets

VOLTAGE GENERATING APPARATUS

BACKGROUND OF THE INVENTION

1. Field of Invention

The present invention generally relates to a voltage generating apparatus, and more particularly to a voltage generating apparatus for generating an output voltage with high accuracy.

2. Description of Prior Art

In an integrated circuit, a band-gap voltage generator is used to provide an output voltage with high accuracy. The output voltage generated by the band-gap voltage generator is independent to a variation of an environment temperature, and the output voltage is provided to a core circuit of the integrated circuit for keeping a performance of the core circuit in a stable manner.

In the conventional band-gap voltage generator, a plurality of bipolar transistors and a high gain operation amplifier are always necessary. That is, the band-gap voltage generator consumes large current when operating.

SUMMARY OF THE INVENTION

The present invention provides a voltage generating apparatus for generating an output voltage with high accuracy and low power consumption.

The voltage generating apparatus includes a reference voltage generator and an output voltage generator. The reference voltage generator is used for generating a reference voltage, and the reference voltage generator decides to generate the reference voltage or not according to a control signal. The output voltage generator is coupled to the reference voltage generator. The output voltage generator includes a comparator, a variable resistor and a current source. The comparator compares the reference voltage and an output voltage to generator a calibrating signal. The variable resistor is coupled to the comparator, and a resistance of the variable resistor is decided by the calibrating signal. The current source is coupled to the variable resistor, and the current source provides an output current to flow through the variable resistor for generating the output voltage. Wherein, the reference voltage is generated during an initial timing period, and the generator is turned off after the initial timing period. The initial timing period is determined according to the control signal.

Accordingly, the present disclosure provides a reference voltage generator for generating a reference voltage with high accuracy to the output voltage generator. The output voltage generator generates an output voltage according to the reference voltage, and when the output voltage is generated stably, the reference voltage generator is cut off. That is, the output voltage generator can generate the output voltage with high accuracy by referring to the reference voltage with high accuracy. Moreover, the reference voltage generator is cut off for saving a power consumption of the voltage generating apparatus. The voltage generating apparatus for generating the output voltage with high accuracy with lower power consumption can be achieved.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
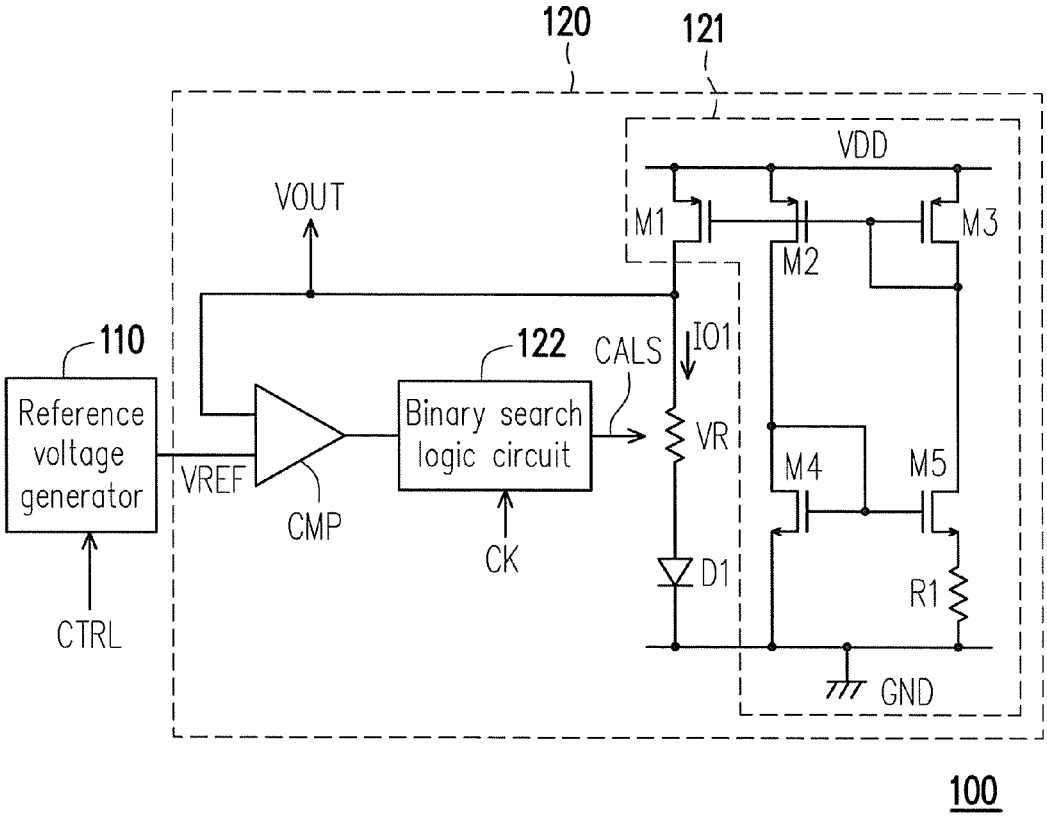
FIG. 1 is a circuit diagram of a voltage generating apparatus according to an embodiment of the invention.

Reference will now be made in detail to the present preferred embodiment of the invention, examples of which are illustrated in the accompanying drawings. Wherever possible, the same reference numbers are used in the drawings and the description to refer to the same or like parts.

Referring to FIG. 1, FIG. 1 is a circuit diagram of a voltage generating apparatus according to an embodiment of the invention. The voltage generating apparatus 100 includes a reference voltage generator 110 and an output voltage generator 120. The reference voltage generator 110 generates a reference voltage VREF, and the reference voltage generator 110 decides to generate the reference voltage VREF or not according to a control signal CTRL. The reference voltage VREF is provided to the output voltage generator 120, wherein a voltage level of the reference voltage VREF may be independent to an environment temperature.

The reference voltage generator 110 is controlled by the control signal CTRL, and the reference voltage generator 110 provides the reference voltage VREF to the output voltage generator 120 during an initial timing period. Further, the reference voltage generator 110 is cut off after the initial timing period, wherein, the initial timing period is determined by the control signal CTRL.

In the embodiment, the output voltage generator 120 is coupled to the reference voltage generator 110. The output voltage generator 120 includes a comparator CMP, a current source 121, a binary search logic circuit 122, a variable resistor VR, and a diode D1. The current source 121 is coupled to the variable resistor VR, and provides an output current IO1 to the variable resistor VR. The variable resistor VR and the diode D1 are coupled in series between the current source 121 and a reference ground GND. When the output current IO1 flows through the variable resistor VR and the diode D1, the output voltage VOUT may be generated on a coupled end of the current source 121 and the variable resistor VR.

Please notice here, a voltage level of the output voltage VOUT may be determined by a resistance of the variable resistor VR. In FIG. 1, the resistance of the variable resistor VR is controlled by a calibrating signal CALS. The calibrating signal CALS is generated by the binary search logic circuit 122. Herein, the binary search logic circuit 122 is coupled between the comparator CMP and the variable resistor VR.

The comparator CMP is used to compare the reference voltage VREF from the reference and transmits a comparing result to the binary search logic circuit 122. The binary search logic circuit 122 generates the calibrating signal CALS according to an output of the comparator by a binary search algorithm based on a clock signal CK.

The binary search algorithm is well known for a person skilled in the art, and the detail for the binary search algorithm is not described here.

The current source 121 includes transistors M1~M5, and resistor R1. First ends of the transistors M1~M3 are coupled to the operating voltage VDD, and control ends of the transistors M1~M3 are coupled together. The control end of the transistor M3 is further coupled to a second end of the transistor M3. A second end of the transistor M1 is coupled to the variable resistor VR for providing the output current IO1. Second ends of the transistors M2 and M3 are respectively coupled to first ends of the transistors M4 and M5. A control end of the transistor M4 is coupled to the second end of the second transistor M2 and a control end of the transistor M5. A second end of the transistor M4 is coupled to the reference ground GND. The resistor R1 is coupled between a second end of the transistor M5 and the reference ground GND.

About the detail operation of the voltage generating apparatus 100, firstly, during the initial timing period, the reference voltage generator 110 generates and provides the reference voltage VREF to the output voltage generator 120. Then, the output voltage generator 120 generates the output voltage VOUT by reference to the reference voltage VREF, and the reference voltage generator 110 is cut off after the initial timing period.

The output voltage VOUT may have a high accuracy by referring to the high accuracy reference voltage 110, and the power consumption may be saved because of the reference voltage generator 110 is cut off after the initial timing period. That is, the output voltage VOUT can be generated with low power consumption by the voltage generating apparatus 100 can be achieved.

Figure 2:
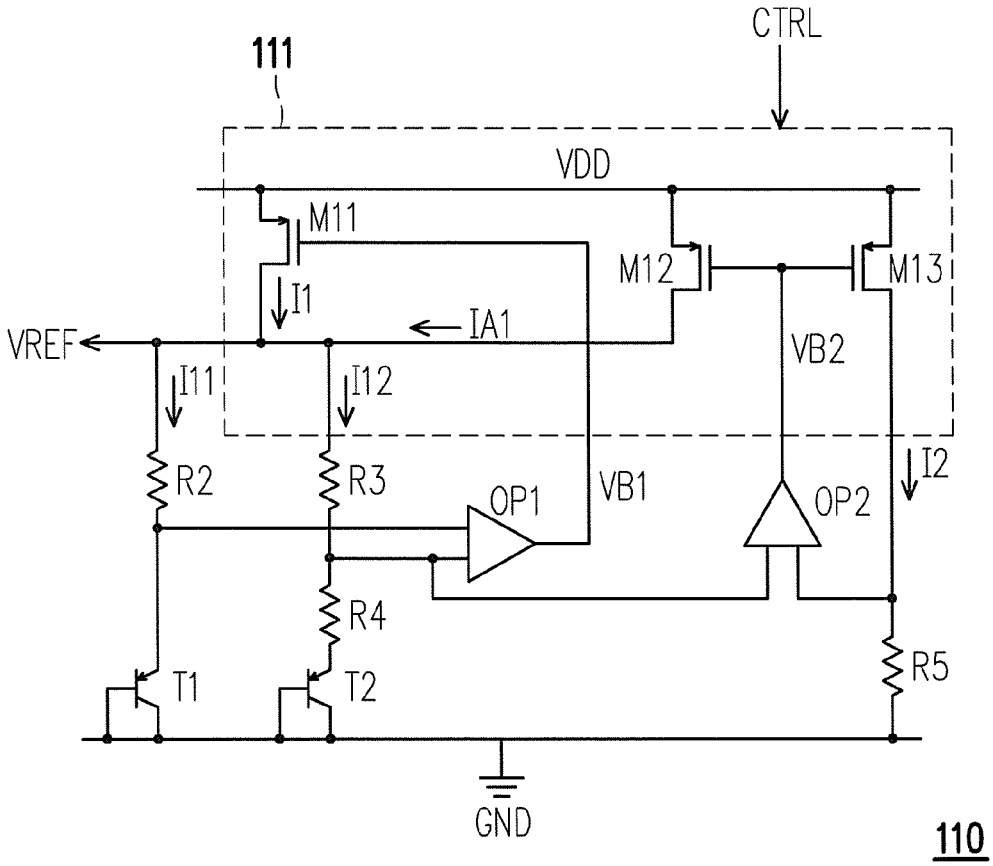
FIG. 2 is a circuit diagram of the reference voltage generator according an embodiment of the invention.

Please referring to FIG. 2, FIG. 2 is a circuit diagram of the reference voltage generator according an embodiment of the invention. In FIG. 2, the reference voltage generator 110 includes a current generator 111, resistors R2~R5, transistors T1~T2 and amplifiers OP1 and OP2. The current generator 111 generates currents I1, IA1 and I2 according to bias voltages VB1 and VB2. Wherein, the current I1 and IA1 form a first current of the current generator 111, and the current I2 is the second current of the current generator 111. A first end of the resistor R2 receives one part of the current I1 (I11), and a second end of the resistor R2 is coupled to a first end of the transistor T1. A second and a control end of the transistor T1 are coupled to the reference ground GND. The resistor R2 and R4 are coupled in series between the current generator 111 and the transistor T2. A first end of the resistor R3 receives another part the current I1 (I12), and a second end of the resistor R3 is coupled to a first end of the resistor R4. A second end of the resistor R4 is coupled to a first end of the transistor T2, and a second and a control end of the transistor T2 are coupled to the reference ground GND.

Two input ends of the amplifier OP1 are respectively coupled to the second ends of the resistor R2 and R3. An output end of the amplifier OP1 generates the bias voltage VB1. Two input ends of the amplifier OP2 are respectively coupled to the first ends of the resistor R4 and R5. An output end of the amplifier OP2 generates the bias voltage VB2. Furthermore, a second end of the resistor R5 is coupled to the reference ground GND, and the first end of the resistor R5 receives the current I2 from the current generator 111.

In this embodiment, the current generator 111 includes transistors M11~M13. First ends of the transistors M11~M13 are coupled to the operating voltage VDD, second end of the transistors M11 and M12 are coupled to the first ends of resistors R2 and R3 for providing the current I1, and a second end of the transistor M13 is coupled to the first end of the resistor R5 for providing the current I2. A control end of the transistor M11 is coupled to the output end of the amplifier for receiving the bias voltage VB1. Control ends of the transistors M12 and M13 are coupled to the output end of the amplifier OP2 for receiving the bias voltage VB2.

Besides, a temperature coefficient of the current I1 and the temperature coefficient of the current I2 are complementary. The temperature coefficient of the current I2 and a temperature coefficient of the current IA1 are the same. For example, the temperature coefficient of the current I1 is positive temperature coefficient and the temperature coefficient of the current I11 is negative temperature coefficient. Such as that, the current I11 received by the resistor R2 is independent to the environment temperature, and the reference voltage VREF is independent to the environment temperature correspondingly.

Please notice here, the current generator 111 also receives the control signal CTRL. When the control signal CTRL indicates that the current generator 111 is in the initial timing period, the currents I1, IA1 and I2 are generated normally by the current generator 111. On the contrary, when the control signal CTRL indicates that the current generator 111 is not in the initial timing period, the currents I1, IA1 and I2 are stopped to generate by the current generator 111. The current generator 111 may be cut off by turning off the path for the transistors M11~M13 receiving the operating voltage VDD.

Figure 3:
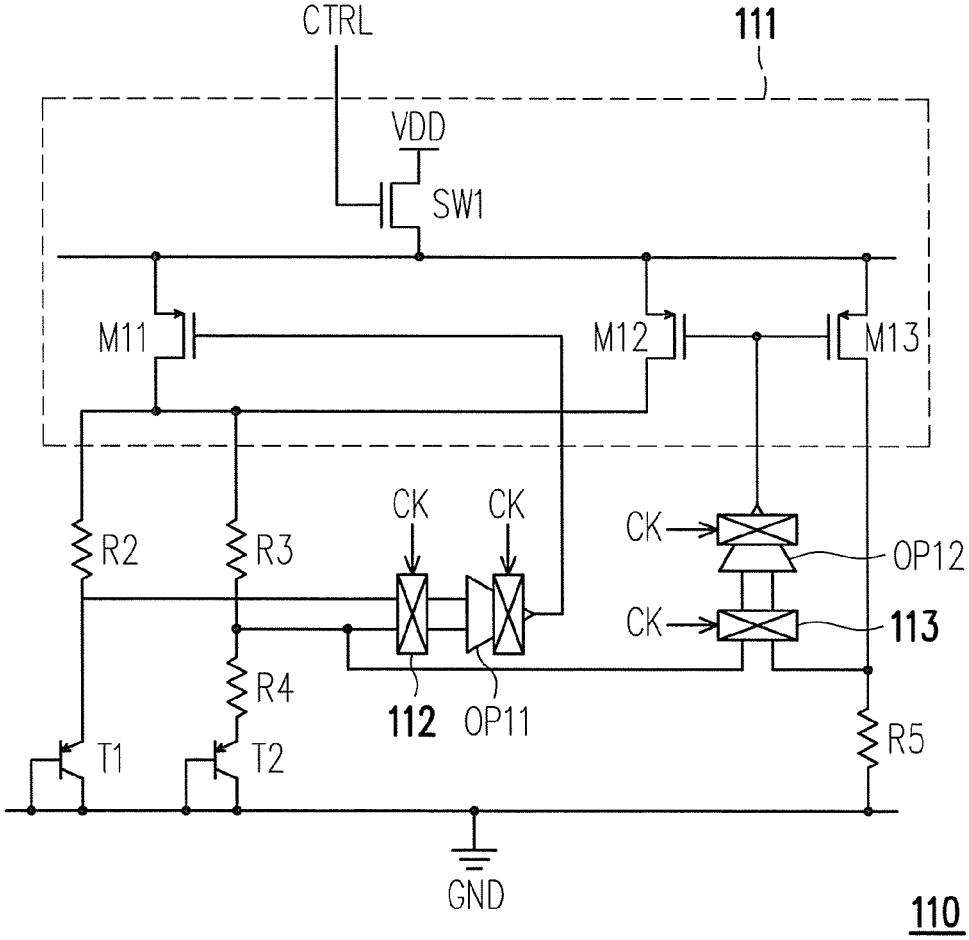
FIG. 3 is another circuit diagram of the reference voltage generator according an embodiment of the invention.

Please referring to FIG. 3, FIG. 3 is another circuit diagram of the reference voltage generator according an embodiment of the invention. In FIG. 3, the reference voltage generator 110 includes a current generator 111, resistors R2~R5, transistors T1~T2, amplifiers OP11 and OP12, switch SW1, and choppers 112 and 113. Different from the reference voltage generator 110 in FIG. 2, the reference voltage generator 110 in FIG. 3 includes two choppers 112 and 113, and the chopper 112 is coupled between the amplifier OP11 and the resistors R2~R4, the chopper 113 is coupled between the amplifier OP12 and the resistors R3~R5. In detail, two input ends of the chopper 112 are respectively coupled to the second end of the resistors R2 and R3, and two output ends are respectively coupled to the input ends of the amplifiers OP11. Two input ends of the chopper 113 are respectively coupled to the first end of the resistors R4 and R5, and two output ends are respectively coupled to the input ends of the amplifiers OP12. Moreover, each of the amplifiers OP11 and OP12 has a chopper output stage. The choppers 112 and 113 and the chopper output stages are operated based on the clock signal CK, and the choppers 112 and 113 and the chopper output stages are used to eliminate offset voltages of the amplifiers OP11 and OP12.

In FIG. 3, a switch SW1 controlled by the control signal CTRL may be placed between the transistors M11~M13 and the operating voltage VDD. The switch SW1 may be turned on during the initial timing period, and the switch may be turned off after the initial timing period according to the control signal CTRL.

In summary, the voltage generating apparatus provides the reference voltage generator for generating a reference voltage with high accuracy. The voltage generating apparatus also provides an output voltage generator to generate the output voltage by referring to the reference voltage. When the output voltage has been generated, the reference voltage generator is cut off for saving power consumption. That is, the output voltage with high accuracy can be generated, and the power consumption also can be saved by the embodiments of presented disclosure.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents

What is claimed is:

1. A voltage generating apparatus, comprising:

a reference voltage generator for generating a reference voltage, the reference voltage generator deciding to generate the reference voltage or not according to a control signal; and an output voltage generator coupled to the reference voltage generator, the output voltage generator comprising:

a comparator comparing the reference voltage and an output voltage to generate a calibrating signal;

a variable resistor coupled to the comparator, a resistance of the variable resistor being decided by the calibrating signal;

a current source coupled to the variable resistor, the current source providing an output current to flow through the variable resistor for generating the output voltage;

a binary search logic circuit coupled between the comparator and the variable resistor, wherein the binary search logic circuit generates the calibrating signal according to an output of the comparator by a binary search algorithm; and a diode, wherein a cathode of the diode is coupled to a reference ground, and an anode of the diode is coupled to the variable resistor, wherein the reference voltage is generated during an initial timing period, and the generator is turned off after the initial timing period, the initial timing period is determined according to the control signal.

2. The voltage generating apparatus according to claim 1, wherein the current source comprises:

a first transistor having a first end, a second end and a control end, wherein the first end of the first transistor is coupled to an operating voltage, the second end of the first transistor is coupled to the variable resistor, the output voltage is generated on the second end of the first transistor;

a second transistor having a first end, a second end and a control end, wherein the first end of the second transistor is coupled to the operating voltage, the control end of the second transistor is coupled to the control end of the first transistor;

a third transistor having a first end, a second end and a control end, wherein the first end of the third transistor is coupled to the operating voltage, the control end of the third transistor is coupled to the control end of the second transistor and the second end of the third transistor;

a fourth transistor having a first end, a second end and a control end, wherein the first end of the fourth transistor is coupled to the second end of the second transistor and the control end of the fourth transistor, the second end of the fourth transistor is coupled to a reference ground;

a fifth transistor having a first end, a second end and a control end, wherein the first end of the fifth transistor is coupled to the second end of the third transistor, the control end of the fifth transistor is coupled to the control end of the fourth transistor; and a resistor coupled between the second end of the fifth transistor and the reference ground.

3. The voltage generating apparatus according to claim 1, wherein the reference voltage generator comprises:

a current generator receiving a control signal, a first bias voltage and a second bias voltage, wherein the first current generator generates a first and second currents according to the first and second bias voltages during the initial timing period;

a first resistor, wherein a first end of the first resistor is coupled to the first current generator for receiving a first part of the first current;

a second resistor having a first end for receiving a second part of the first current;

a third resistor having a first end coupled to a second end of the second resistor;

a first transistor having a first end, a second end and a control end, wherein the first end of the first transistor is coupled to a second end of the first resistor, the second and control ends of the first transistor are coupled to a reference ground;

a second transistor having a first end, a second end and a control end, wherein the first end of the first transistor is coupled to a second end of the third resistor, the second and control ends of the second transistor are coupled to the reference ground;

a fourth resistor, wherein a first end of the fourth resistor is coupled to the current generator for receiving the second current, a second end of the fourth resistor is coupled to the reference ground;

a first amplifier having a first input end, a second input end and an output end, wherein the first input end of the first amplifier is coupled to the second end of the first resistor and the second input end of the first amplifier is coupled to the second end of the second resistor, the output end of the first amplifier generates the first bias voltage; and a second amplifier having a first input end, a second input end and an output end, wherein the first input end of the second amplifier is coupled to the second end of the second resistor, the second input end of the second amplifier is coupled to the first end of the fourth resistor, the output end of the second amplifier generates the second bias voltage.

4. The voltage generating apparatus according to claim 3, wherein the initial timing period is determined by the control signal.

5. The voltage generating apparatus according to claim 3, wherein the current generator comprises:

a third transistor has a first end, a second end and a control end, wherein the first end of the third transistor is coupled to an operating voltage, the control end of the third transistor receives the first bias voltage, the second end of the third transistor provides the first current;

a fourth transistor has a first end, a second end and a control end, wherein the first end of the fourth transistor is coupled to the operating voltage, the control end of the fourth transistor receives the second bias voltage, and the second end of the fourth transistor is coupled to the second end of the third transistor; and a fifth transistor having a first end, a second end and a control end, wherein the first end of the fifth transistor is coupled to the operating voltage, the control end of the fifth transistor receives the second bias voltage, and the second end of the fifth transistor provides the second current.

6. The voltage generating apparatus according to claim 3, wherein the current generator further comprises:

a first chopper having a first input end, a second input end, a first output end and a second output end, wherein the first and second input ends of the first chopper are respectively coupled to the second ends of the first and second resistors, the first and second output ends of the first chopper are respectively coupled to the first and second input ends of the first amplifier.

7. The voltage generating apparatus according to claim 3, wherein the current generator further comprises:

a second chopper having a first input end, a second input end, a first output end and a second output end, wherein the first and second input ends of the second chopper are respectively coupled to the first ends of the third and fourth resistors, the first and second output ends of the second chopper are respectively coupled to the first and second input ends of the second amplifier.

8. The voltage generating apparatus according to claim 3, wherein each of the first and the second amplifiers has a chopper output stage.

* * * * *